US008479748B1

(12) United States Patent
Satir

(10) Patent No.: US 8,479,748 B1
(45) Date of Patent: Jul. 9, 2013

(54) HAIR STYLING ACCESSORY

(76) Inventor: Gursel Satir, New Hyde Park, NY (US)

( * ) Notice: Subject to any disclaimer, the term of this patent is extended or adjusted under 35 U.S.C. 154(b) by 0 days.

(21) Appl. No.: 13/246,061

(22) Filed: Sep. 27, 2011

(51) Int. Cl.
*A45D 24/16* (2006.01)
*A45D 24/34* (2006.01)

(52) U.S. Cl.
USPC ..... 132/108; 132/213.1

(58) Field of Classification Search
USPC ..... 132/108, 215, 148, 149, 152, 221, 132/270; 2/16, 21, 160, 163
See application file for complete search history.

(56) References Cited

U.S. PATENT DOCUMENTS

| | | | | |
|---|---|---|---|---|
| 1,847,401 | A * | 3/1932 | Klein | 132/148 |
| 2,180,394 | A * | 11/1939 | Bowyer | 132/149 |
| 2,411,252 | A * | 11/1946 | Finman | 132/149 |
| 2,467,975 | A * | 4/1949 | Hollen | 132/149 |
| 2,821,203 | A * | 1/1958 | Kesterson et al. | 132/149 |
| 4,689,828 | A | 9/1987 | Brewer | |
| 4,751,747 | A | 6/1988 | Banks et al. | |
| 4,766,914 | A | 8/1988 | Briggs | |
| 5,009,195 | A | 4/1991 | Damm | |
| 5,261,426 | A | 11/1993 | Kellett et al. | |
| 5,826,599 | A | 10/1998 | Adams | |
| 5,944,031 | A | 8/1999 | Farley et al. | |
| 6,021,783 | A * | 2/2000 | Phillips | 132/200 |
| 6,189,150 | B1 | 2/2001 | Jones-Roberson | |
| 6,260,203 | B1 | 7/2001 | Battle | |
| 6,647,549 | B2 | 11/2003 | McDevitt et al. | |
| 7,020,898 | B1 | 4/2006 | Pucci et al. | |
| 7,337,784 | B2 | 3/2008 | Hurwitz | |
| 7,346,955 | B2 | 3/2008 | De Laforcade | |
| 8,245,715 | B1 * | 8/2012 | Davis | 132/213.1 |
| 2003/0056274 | A1 | 3/2003 | Sorrels | |
| 2006/0090771 | A1 * | 5/2006 | Ramet | 132/200 |
| 2010/0163071 | A1 | 7/2010 | Everett, Jr. et al. | |

FOREIGN PATENT DOCUMENTS

FR 2598064 A1 11/1987

OTHER PUBLICATIONS

Zetex Finger Cots, From Grainger.com.
Finger Protectors From Perfectlocks.com.

* cited by examiner

*Primary Examiner* — Rachel Steitz
(74) *Attorney, Agent, or Firm* — David W. Denenberg; Davidoff Hutcher & Citron LLP

(57) ABSTRACT

Accessory for use in hair styling includes two rectangular panels, attachment structure that enables each panel to be brought into and maintained in a tubular form, a connecting part that connects the panels together and at least one hair styling implement or attachment, each arranged in connection with one of the panels. For use, the panels are brought into and maintained in their tubular form and arranged around a respective one of a pair of adjacent fingers of a user. The user can then pass hair between the panels while the implement interacts with the hair. If the accessory is used in conjunction with ironing hair, then the panels include thermally insulative material to prevent heat transfer from the hot hair to the user's fingers.

12 Claims, 3 Drawing Sheets

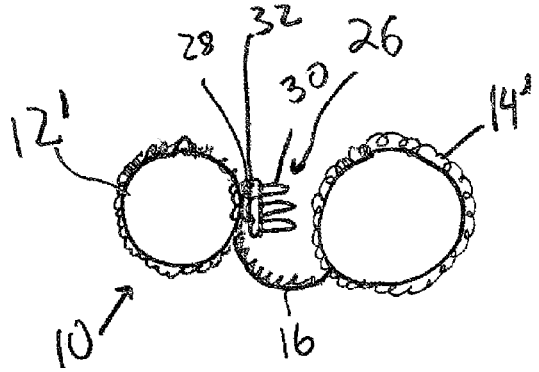
FIG. 4
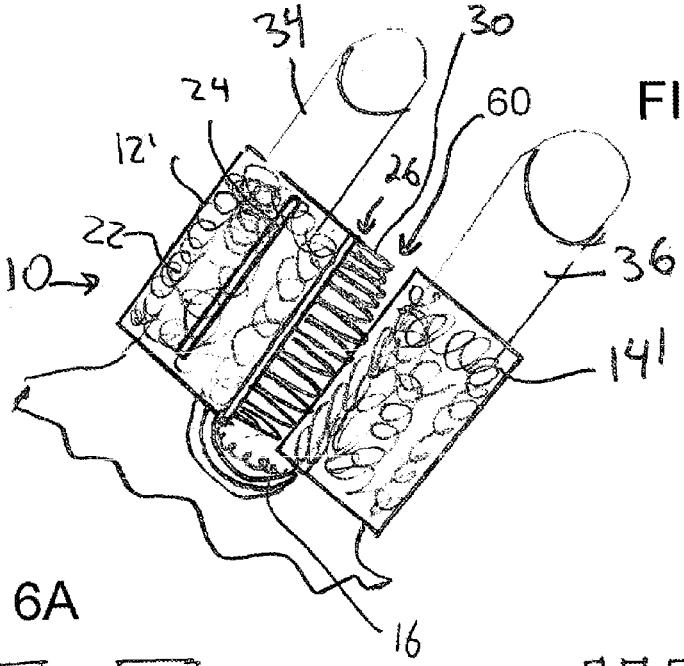
FIG. 5
FIG. 6A
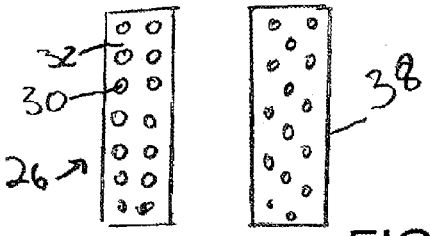
FIG. 6B
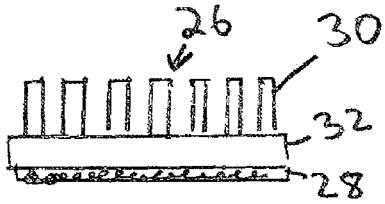
FIG. 7

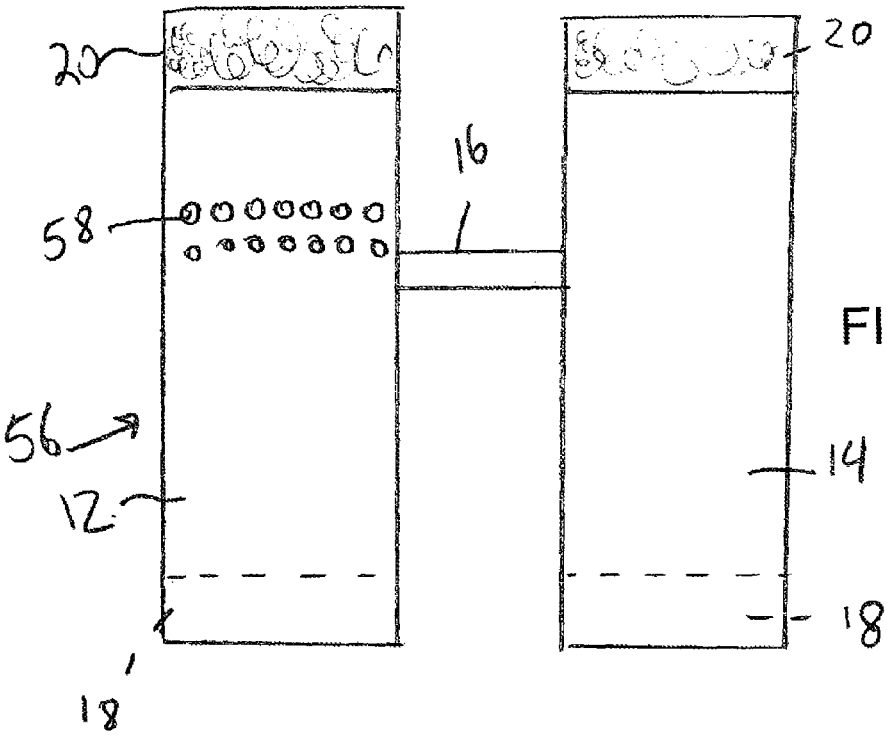
FIG. 10
FIG. 9
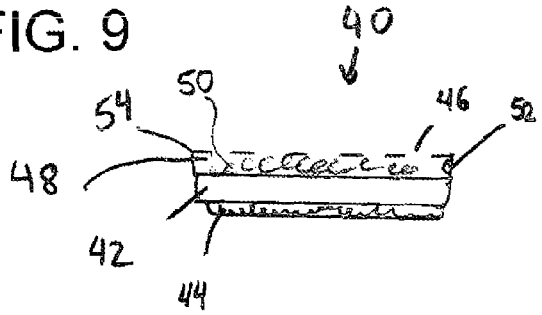
FIG. 8
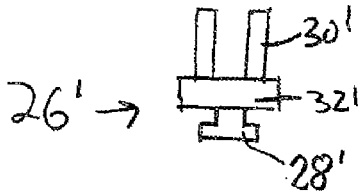

HAIR STYLING ACCESSORY

FIELD OF THE INVENTION

The present invention relates generally to a hair styling accessory that is attached to two fingers of a hair stylist and more particularly to such a hair styling accessory that may be used in conjunction with a hot iron and enables the hair stylist to manipulate the hair while hot. Even more specifically, the present invention relates to an apparatus that encompasses two fingers with a bridge or connecting part therebetween and that preferably has thermal insulating properties allowing use with hot irons incidental with hair styling.

BACKGROUND OF THE INVENTION

Gloves are often used to protect a wearer's hands from heat exposure but, without modification, would be cumbersome if used by a hair stylist to handle hair heated by a flat or curling iron.

Various modifications to conventional gloves have therefore been developed for particular use by hair stylists.

For example, to facilitate better handling of hair after or in conjunction with use of an iron, Banks et al., in U.S. Pat. No. 4,751,747, discloses a three-fingered glove to shield the hand of a beautician including a pair of finger-encompassing sheaths having a stretchable back that extends and envelopes a forefinger and middle finger of a wearer's hand and thermal insulating material on a side planar to the palm of the hand and a stretchable fabric on the remaining back portion configured to grip and maintain the sheath upon the fingers of the wearers hand when placed thereupon through the retractable nature of the stretch fabric. Further, the glove includes a thumb-encompassing sheath that is adapted to stretchably surround the thumb of the wearer's hand and has thermal insulating material on the same side as the palm of the hand and stretchable fabric on the remaining portion. The thumb-encompassing sheath is configured to grip and maintain the sheath upon the thumb of the hand when placed thereupon in view of the retractable nature of the stretch fabric. The glove also includes a narrow bridge of thermal insulating material integral with, and connected to the finger and thumb-encompassing sheaths, forming an insulating web therebetween. The bridge does not impede the movement of the fingers thereby allowing a hot hair iron to be handled without burning the hand contiguously engaging the iron while manipulating hair around the iron during the process of hair curling by a beautician.

Subsequent to Banks et al., Battle, in U.S. Pat. No. 6,260,203, disclose a more complete protective glove for hair stylists for protecting a hair stylist's hands from being burned while using hot irons. This glove includes a glove portion comprised of an open wrist portion for receiving a hand therein, a palm portion, a back portion, a thumb portion, an index finger portion, a middle finger portion, a ring finger portion, and a pinkie finger portion. The thumb portion, middle finger portion, ring finger portion, and pinkie finger portion each have an open upper end whereby tips of these fingers of the hand are exposed. The glove portion includes an internal padded layer and an external fabric layer, and a thermal shield disposed over the external fabric layer. The thermal shield covers the palm portion, the index finger portion, and an interior of the middle finger portion. The open wrist portion includes a tightening strap that can be closed to secure the glove portion of the hand.

Aside from the difficulty of the hair stylists needing to handle hot hair, it is also a problem for the hair stylist to avoid cutting themselves while using a scissor to cut hair. A modified glove that addresses this problem is disclosed in Brewer, U.S. Pat. No. 4,689,828. Brewer discloses a finger protector for hair stylist's fingers useful to protect the index finger and second finger of one hand from being pierced and cut by scissors which are used in the other hand during the cutting and styling of hair. This finger protector includes an open-ended, two-finger body having a lower open end portion, a web portion between the two fingers and an upper open end portion which extends from the lower end portion to cover the first knuckles of the index and second fingers. The unitary two-fingered body portion is thickened on the inside for the index finger and the second finger. The web portion between the index finger and the second finger separates these fingers at an angle between about 25° to about 35°. This angular separation facilitates pulling the body over the index and second fingers over the knuckles and into the web between the two fingers in the palm area while permitting the remaining fingers and the thumb to curl below the index finger and second finger and to be completely exposed when the hair stylist grasps the tips of the hair for cutting.

The foregoing patents do not disclose a hair styling accessory that can be attached to only two adjacent fingers of a hair stylist and allow for use in conjunction with ironing as well as with different hair styling implements.

SUMMARY OF THE INVENTION

An accessory for use in hair styling in accordance with the invention includes a first substantially rectangular panel, a first attachment structure arranged on the first panel and that enables the first panel to be brought into and maintained in a tubular form, a second substantially rectangular panel, a second attachment structure arranged on the first panel and that enables the second panel to be brought into and maintained in a tubular form, a connecting part that connects the first and second panels together and at least one hair styling implement or attachment, each arranged in connection with the first panel or the second panel. The implements are separable from the panels, thereby constituting attachments, or integral with the panel(s).

For use, the first and second panels are brought into and maintained in their tubular form and as such, arranged around a respective one of a pair of adjacent fingers of a user. The user can then pass hair between the first and second panels while the implement interacts with the hair. If the accessory is used in conjunction with ironing hair, then the first and second panels include thermally insulative material to prevent heat transfer from the hot hair to the user's fingers.

The accessory does not engage with more than two fingers of the user, and when the implement is an attachment that is separable from the panels, the accessory allows for the independent use of different attachments, as desired by the user.

Another way to consider the invention is in its use state in which it comprises a first substantially tubular portion adapted to fit over one finger of a user, a second substantially tubular portion adapted to fit over an adjacent finger of the user, a connecting part that connects the first and second tubular portions together, and at least one hair styling implement, each arranged in connection with the first or second tubular portion. Use of this embodiment of the invention is substantially the same as for the previously described embodiment.

BRIEF DESCRIPTION OF THE DRAWINGS

For a better understanding of the present invention, reference is made to the following description and accompanying drawings, while the scope of the invention is set forth in the appended claims:

FIG. 4 is an end view of the hair styling accessory from the state shown in FIG. 3;

FIG. 5 is a perspective view showing the hair styling accessory in a position of use attached to two fingers of a hair stylist;

FIG. 6A is a top view of one attachment for the hair styling accessory in accordance with the invention;

FIG. 6B is a top view of another attachment for the hair styling accessory in accordance with the invention;

FIG. 7 is a side view of the attachment for the hair styling accessory in accordance with the invention shown in FIG. 6A;

FIG. 8 is a front view of another attachment for the hair styling accessory shown in FIG. 1;

FIG. 9 is a side view of another attachment for the hair styling accessory shown in FIG. 1; and FIG. 10 is top view of a second embodiment of a hair styling accessory in accordance with the invention.

DETAILED DESCRIPTION OF THE INVENTION

Figure 1:
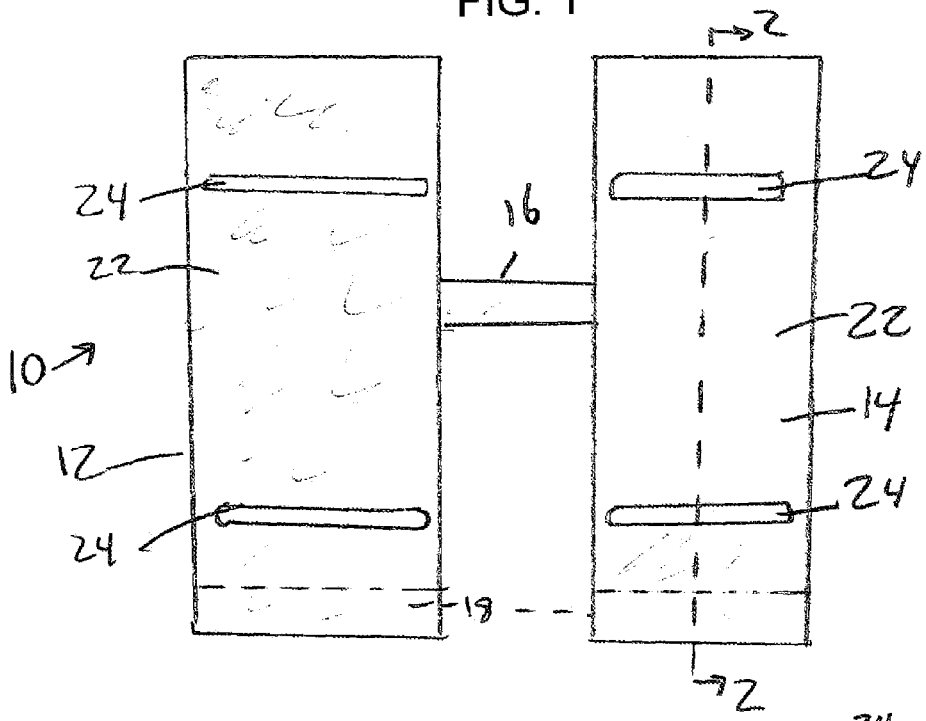
FIG. 1 is top view of a first embodiment of a hair styling accessory in accordance with the invention.

Referring to the accompanying drawings wherein like reference numbers refer to the same or similar elements, FIG. 1 is a front view of a hair accessory in accordance with the invention which is designated generally as 10. Hair accessory 10 includes a first substantially rectangular panel 12, a second substantially rectangular panel 14 and a connecting part 16 that connects the first and second rectangular panels 12, 14 together. Hair accessory 10 thus has a substantially H-shape when in the non-use state shown in FIG. 1.

The length of each rectangular panel 12, 14, i.e., the vertical dimension as shown in FIG. 1, is selected to enable each rectangular panel 12, 14 to wrap around a respective finger of the hair stylist and attach to itself. Thus, the accessory can only attach to two fingers of the user, in view of the presence of only two rectangular panels 12, 14.

The width of each rectangular panel 12, 14, i.e., the horizontal dimension as shown in FIG. 1, is selected to enable each rectangular panel 12, 14 to overlie a portion of the circumference of the respective finger of the hair stylist. The size of the connecting part 16 is selected to enable the accessory 10 to be attached to an adjacent pair of fingers without the connecting part 16 interfering with the positioning of the rectangular panels 12, 14 over the adjacent fingers. To this end, the connecting part 16 is preferably a thin, narrow strip of material.

To enable each rectangular panel 12, 14 to attached to itself and encircle a respective finger of the hair stylist, an attachment structure is incorporated into each rectangular panel 12, 14. In the embodiment illustrated in FIG. 1, the attachment structure comprises a first portion of hook or look fasteners 18 attached to the lower side of the rectangular panels 12, 14 at one end thereof, and a second portion of hook or look fasteners 20 attached to the upper side of the rectangular panels 12, 14 at one end thereof (see FIG. 2). The hook and loop fasteners used in the first and second portions 18, 20 may be VELCRO®. As such, when each rectangular panel 12, 14 is brought into a substantially tubular state (which state is referred to respectively as 12' and 14'), the first and second portions of hook and loop fasteners 18, 20 can be attached to one another thereby securing the rectangular panels 12, 14 in their tubular form and in use, around a respective finger of the hair stylist (see FIG. 5). Importantly, this attachment is not permanent and the hair stylist can pull the first and second portions of hook and loop fasteners 18, 20 apart from one another in order to remove the rectangular panels 12, 14 from the hair stylist's fingers.

Instead of hook and loop fasteners, any other attachment means that provide for a temporary attachment of two different areas of the rectangular panels 12, 14 together in order to provide the panels 12, 14 with their tubular, use form may be used in accordance with the invention, including but not limited to, clasps, buttons and the like.

Referring back to FIG. 1, the upper surface of each of the rectangular panels 12, 14 is provided with hook and loop fasteners 22 and/or slots 24. The coverage area of the hook and loop fasteners 22, when present, may vary and the number and position of the slots 24, when present, may also vary, A primary purpose of the hook and loop fasteners 22 and slots 24 is to allow for temporary attachment of a hair styling attachment, implement or accessory 26, hereinafter referred to as an attachment for the purpose of describing the embodiments of FIGS. 1-9. Only one of the rectangular panels 12, 14 may be provided with hook and loop fasteners 22 and/or slots 24, or both may be provided with hook and loop fasteners 22 and/or slots 24. If both are provided with hook and loop fasteners 22 and/or slots 24, the coverage area of the hook and loop fasteners 22 and the number and position of the slots 24 may vary between the rectangular panels 12, 14.

Figure 2:
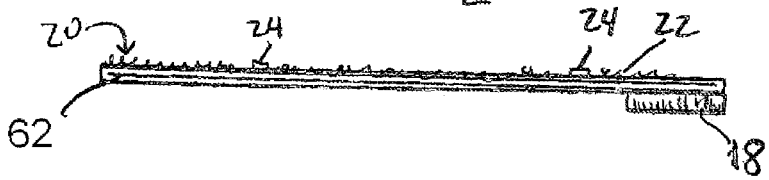
FIG. 2 is a cross-section of the hair styling accessory shown in FIG. 1 taken along the line 2-2 of FIG. 1.
Figure 3:
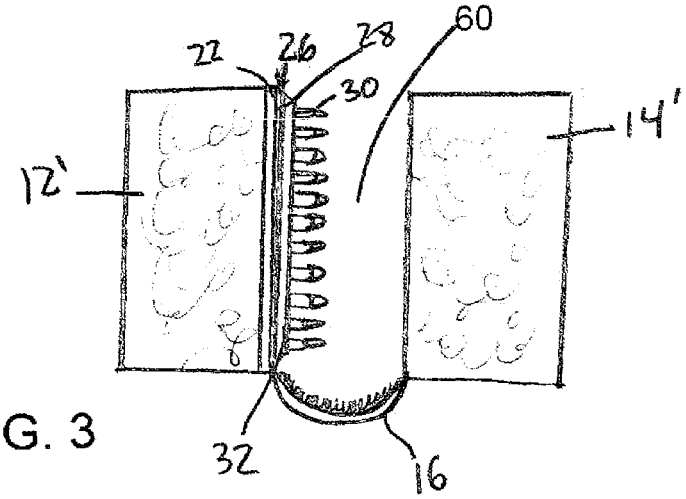
FIG. 3 is a side view of the hair styling accessory shown in FIG. 1 in a state in which it is used, while attached to two fingers of the hair stylist.

For example, FIGS. 3 and 4 show the attachment 26 attached to the hook and loop fasteners 22 of rectangular panel 12'. Attachment 26 includes a base 32, an area of complementary hook and loop fasteners 28 that engage with the hook and loop fasteners 22 and are situated on one side of the base 32 of the attachment 26, and a plurality of projections 30 extending from the opposite side of the attachment base 32. As such, the base 32 supports both the hook and loop fasteners 28 and the projections (seen most clearly in FIG. 7). The projections 30 on the same attachment 26 may be uniform or vary in one or more of their characteristics, e.g., projections 30 may have substantially the same height as shown in FIG. 2, or the projections 30 may have a variable height as shown in FIG. 5. The material from which the projections 30 are formed, and the manner in which they can be formed integral with a base 32 is well known to those skilled in the art to which this invention pertains.

In use, the attachment 26 can be stuck onto the rectangular panel 12 by pressing the hook and loop fasteners 28 on the attachment 26 against an opposite one of hook and loop fasteners 22 on the rectangular panel 12 (to provide the state shown in FIG. 3). Preferably, the attachment 26 is stuck onto the rectangular panel 12 in a position in which the projections 30 face the opposing rectangular panel 14 so that the projections will interact with hair being pulled through a gap 60 between the rectangular panels 12, 14 (see FIGS. 3 and 5).

Alternatively, instead of the hook and loop fasteners 28 on the base 32, an attachment 26' may be provided with a mounting projection 28' formed or arranged on the lower surface of the base 32' (see FIG. 8) to engage with one of the slots 24 on the rectangular panel 12, 14. Projections 30' are formed on the upper surface of the same base 32'. In this embodiment, the attachment 26' is slid or otherwise engaged with the rectangular panel 12, 14 by means of engagement of the mounting projection 28' with a respective slot 24. Removal of the attachment 26' from engagement with the rectangular panel 12, 14 is achieved by sliding or otherwise separating the mounting projection 28' from engagement with the respective slot 24.

In use, the hair stylist will attach the hair accessory 10 to adjacent fingers of one of their hands, typically but not exclusively, their index and middle fingers 34, 36. Rectangular panel in its tubular form 12' would be wrapped around finger 34 while rectangular panel in its tubular form 14' would be wrapped around finger 36 (see FIG. 5). The attachment 26 may be attached to the rectangular panel 12' to face rectangular panel 14' as shown in FIG. 5, either after the rectangular panels 12', 14' have been brought into the tubular form or before. Then, when the hair stylist is ironing a person's hair, they can hold some hair strands by grasping them and retaining them between rectangular panels 12', 14' and simultaneously iron a different part of the hair strands that are retained between the rectangular panels 12', 14'. If the hair stylist is ironing hair strands and then wants to grasp the already ironed hair strands, they may also do so by grasping the ironed hair strands between the rectangular panels 12', 14' in engagement with the projections 30.

The rectangular panels 12, 14 are preferably made from or include thermally insulative material 62 (schematically shown in FIG. 2). As such, heat arising from the ironed hair strands does not transfer through the accessory 10 to the fingers 34, 36 of the hair stylist. The composition and heat transfer properties of the thermally insulative material 62 can be readily determined by one skilled in the art, with the purpose being to avoid excessive heat transfer from hot hair strands that have been ironed to the hair stylist's fingers to enable the hair stylist unencumbered handling of the ironed hair. Further, the thermally insulative material 62 may be integrated into the panels 12, 14 by layering the material of the panels 12, 14 above and below the thermally insulative material 62 and closing the edges of the material, or by forming the panels with a pocket into which a layer or other form of the thermally insulative material 62 is placed.

Various attachments 26 are envisioned. FIGS. 6A and 6B show variations in the number and arrangement of projections with the attachment 26 in FIG. 6A showing projections 30 arranged in aligning rows and columns on the base 32 while the attachment 38 in FIG. 6B shows staggered rows and columns of projections 30. Generally, the purpose of the projections 30 is to enable the hair stylist to comb the hair, e.g., the hair that is heated after having just been ironed. As such, there are no restrictions on the number, size and arrangement of projections on the attachments.

The projections 30 and base 32 may be made of a suitable plastic material that withstands heat that may be generated when the projections 30 are run through hair strands that have just been ironed. The specific plastic material can be readily determined by one skilled in the relevant art. Further, the projections 30 and base 32 may be formed integral with one another as a unitary member, and that has a lower surface to which the hook and loop fasteners 28 are attached.

A kit including the accessory 10 in accordance with the invention may therefore include several different attachments 26, each with a different number, size and/or arrangement of projections. Attachments may also be packaged and sold separately.

FIG. 9 shows an alternative attachment 40 in accordance with the invention. In this attachment 40, a base 42 has hook or loop fasteners 44 on one side and on the other side, one or more apertures 46 that connect to a reservoir 48 of a hair styling compound 50. The hair styling compound 50 may be conditioner, gel, coloring compositions, dyeing compositions, highlighting compositions and the like. The reservoir 48 may be fillable by suitably constructing an inlet port or inlet valve (shown schematically at 52) into the reservoir 48 and thus the attachment 40 is reusable, or the attachment 40 may be a single use attachment with a reservoir pre-filled with one of the possible hair styling compounds.

The reservoir 48 may also be designed to require application of pressure to cause discharge of the compound from the reservoir. This may be effected by constructing the shell 54 surrounding the reservoir 48 partly or completely from a squeezable plastic or similar material.

In use, the hair stylist would attach the attachment 40 to one of the rectangular panels 12, 14 when in their flat form shown in FIG. 1 or to one of the rectangular panels 12', 14' when in their tubular form shown in FIGS. 3-5. The hair stylist would then position the rectangular panels 12', 14' around their fingers and start to style the person's hair. When discharge of the compound 50 from the attachment 40 is desired, the hair stylist would apply pressure to the attachment 40 causing discharge of the compound 50 through the apertures 46 and into the person's hair being grasped between the rectangular panels 12', 14'.

It is possible to integrate a compound-receiving reservoir with projections so that both a compound-application and styling effect may be provided by a singular attachment.

Referring now to FIG. 10, in this embodiment of the invention, a hair styling implement is incorporated into the accessory, designated 56. As shown in FIG. 10, the hair styling implement comprises a plurality of projections 58 in a common area that are formed on one of the rectangular panels 12, 14. Ideally, the projections 58 should be formed on one of the rectangular panels, panel 12 as shown in FIG. 9, in a position in which they will face the other rectangular panel during use of the accessory 56. As such, the hair stylist is able to comb or style hair by passing hair between the rectangular panels 12', 14' when in their tubular, use form (see FIGS. 3-5) and also cause the projections 58 to interact with the hair.

In one embodiment, to achieve this positioning of the projections, the projections 58 may be arranged proximate or in alignment with the connecting part 16. Since the connecting part 16 will usually lie between the adjacent fingers 34, 36 of the hair stylist (see FIG. 5), the area on the rectangular panels 12, 14 that is proximate or in alignment with the connecting part 16 will typically face one another.

As used herein, a projection that interacts with the hair may be any elevated structure that extends beyond the upper surface of the attachment or the rectangular panel itself when the attachment is incorporated into the rectangular panel (as in the embodiment shown in FIG. 9). A plurality of projections, when present on a common attachment or grouped together, do not have to have the same vertical dimension, the same shape, the same thickness or the same circumference. Rather, the projections in a common attachment or when grouped together may have different vertical dimensions, shapes and/or thickness.

As used herein, a hair stylist is considered to be the person using the accessory in accordance with the invention. This person does not necessarily have to a licensed hair stylist or a hair stylist in a commercial establishment. Rather, the hair stylist as used herein may be any person that uses the accessory for any of its possible purposes, including but not limited to handling, styling, blow-drying, cutting, coloring and dyeing hair.

As used herein, the term "substantially" when referring to the shape of the rectangular panels means that the panels have two pair of generally parallel sides that are oriented perpendicular to one another. Each side is not required to be completely straight and deviations from a straight line along each edge of the rectangular panel are possible, consistent with this definition of "substantially rectangular". Thus, one or more sides of the substantially rectangular panel may include one or more indentations or projections without deviating from the substantial rectangularity of the panel.

As used herein, the term "substantially" when referring to the shape of the rectangular panels when in their tubular form means that the tubular panels have an annular shape with an open interior channel, and an inner surface and an outer surface that are generally concentric. Each surface is not required to be exactly tubular, and might not be in view of the need to attach one area of the panel to another area of the panel resulting in an overlap of these areas of the panels, and thus a double thickness of the panel.

While the foregoing description and drawings represent the preferred embodiments of the present invention, it will be understood that various changes and modifications may be made without departing from the scope of the present invention. For example, the above-mentioned U.S. patents are incorporated by reference herein and their features may be incorporated into the accessory in accordance with the invention.

I claim:

1. An apparatus for use in hair styling, comprising:

a first substantially rectangular panel;

a first attachment structure arranged on said first panel and that enables said first panel to be brought into and maintained in a tubular form;

a second substantially rectangular panel;

a second attachment structure arranged on said first panel and that enables said second panel to be brought into and maintained in a tubular form;

a connecting part that flexibly connects said first and second panels to each other to enable relative movement between said first panel and said second panel; and a hair styling implement arranged in connection with said first panel, whereby when said first and second panels are in their tubular form, they are each positionable around a respective one of a pair of adjacent fingers of a user and flexible relative to one another to enable the user to pass hair between said first and second panels while said implement interacts with the hair.

2. The apparatus of claim 1, wherein said first attachment structure comprises a first area of hook fasteners and a second area of loop fasteners arranged on different portions of said first panel and said second attachment structure comprises a first area of hook fasteners and a second area of loop fasteners arranged on different portions of said second panel.

3. The apparatus of claim 1, further comprising a connecting structure that connects said implement to said first panel.

4. The apparatus of claim 3, wherein said connecting structure comprises one of hook and loop fasteners arranged on said implement and the other of hook and loop fasteners arranged on said first panel.

5. The apparatus of claim 3, wherein said connecting structure comprises a slot arranged on said first panel and a mounting projection arranged on said implement and adapted to releasably engage with said slot.

6. The apparatus of claim 1, wherein said implement comprises a plurality of projections adapted to allow hair to pass therebetween.

7. The apparatus of claim 1, wherein said first and second panels include thermally insulative material.

8. The apparatus of claim 1, wherein said implement is separable from said first panel.

9. The apparatus of claim 1, wherein said attachment is integral with said first panel.

10. The apparatus of claim 1, wherein said first and second panels are configured, when in their tubular form, to prevent contact between hair interacting with said implement and passing between said first and second panels and the adjacent fingers of the user when positioned in said first and second panels.

11. An apparatus for use in hair styling, comprising:

a first substantially rectangular panel;

a first attachment structure arranged on said first panel and that enables said first panel to be brought into and maintained in a tubular form;

a second substantially rectangular panel;

a second attachment structure arranged on said first panel and that enables said second panel to be brought into and maintained in a tubular form;

a connecting part that connects said first and second panels together; and a hair styling implement arranged in connection with said first panel, wherein said implement includes a reservoir adapted to contain a hair styling compound and at least one aperture communicating with said reservoir to enable discharge of the hair styling compound from said reservoir, whereby when said first and second panels are in their tubular form, they are each positionable around a respective one of a pair of adjacent fingers of a user to enable the user to pass hair between said first and second panels while said implement interacts with the hair.

12. An apparatus for use in hair styling, comprising:

a first substantially tubular portion;

a second substantially tubular portion;

a connecting part that connects said first and second tubular portions together; and a hair styling implement arranged in connection with said first tubular portion, wherein said implement includes a reservoir adapted to contain a hair styling compound and at least one aperture communicating with said reservoir to enable discharge of the hair styling compound from said reservoir, whereby said first and second tubular portions are each positionable around a respective one of a pair of adjacent fingers of a user to enable the user to pass hair between said first and second tubular portions while said implement interacts with the hair.

* * * * *